US007365691B2

(12) United States Patent
Kim

(10) Patent No.: US 7,365,691 B2
(45) Date of Patent: Apr. 29, 2008

(54) ANTENNA TUNING OF PORTABLE TERMINAL USING EMI PAINT

(75) Inventor: Reong-Hee Kim, Suwon-si (KR)

(73) Assignee: Samsung Electronics Co., Ltd (KR)

( * ) Notice: Subject to any disclaimer, the term of this patent is extended or adjusted under 35 U.S.C. 154(b) by 24 days.

(21) Appl. No.: 11/318,308

(22) Filed: Dec. 23, 2005

(65) Prior Publication Data

US 2006/0262017 A1 Nov. 23, 2006

(30) Foreign Application Priority Data

May 18, 2005 (KR) ..... 10-2005-0041505

(51) Int. Cl.
*H01Q 1/24* (2006.01)

(52) U.S. Cl. ..... 343/702; 343/841

(58) Field of Classification Search ..... None
See application file for complete search history.

(56) References Cited

U.S. PATENT DOCUMENTS

2006/0139222 A1* 6/2006 Chu ..... 343/713

* cited by examiner

*Primary Examiner*—Trinh Vo Dinh
(74) *Attorney, Agent, or Firm*—The Farrell Law Firm, PC

(57) ABSTRACT

A method for tuning the antenna of a portable terminal including the steps of applying electromagnetic interference (EMI) paint to the inner surface of a case of the terminal; positioning a PCB having a ground inside the terminal; positioning an internal antenna above the upper end of the printed circuit board (PCB) while being spaced at a predetermined height; applying EMI paint to the inner surface of the case in a predetermined pattern to provide a first region having a ground; and applying EMI paint while changing the application pattern to provide a second region extending from the first region and having a ground, the shape of which is varied to change the frequency tuning of the antenna.

5 Claims, 8 Drawing Sheets

CHANGE OF VSWR ACCORDING TO PATTERN
CHANGE OF EMI PAINT

ANTENNA TUNING OF PORTABLE TERMINAL USING EMI PAINT

PRIORITY

This application claims priority to an application entitled "Antenna Tuning of Portable Terminal Using EMI Paint" filed with the Korean Intellectual Property Office on May 18, 2005 and assigned Serial No. 2005-41505, the contents of which are incorporated herein by reference.

BACKGROUND OF THE INVENTION

1. Field of the Invention

The present invention relates to antenna tuning of a portable terminal using electromagnetic interference (EMI) paint, and more particularly to antenna tuning of a portable terminal using EMI paint capable of changing the application pattern of EMI paint, which is applied to the interior of the portable terminal, and varying the shape of the antenna's ground.

2. Description of the Related Art

In line with recent consumer requests, portable communication apparatuses generally tend to have a compact size while incorporating more functions, including voice communication, radio listening, access to Internet, MP3 music downloading, and obtaining various digitalized data and images from portable telephones, personal digital assistants (PDAs), desktop computers, and laptop computers.

Such information is subjected to band compression using audio or video technologies for easy and efficient transmission to various portable communication apparatuses via digital wireless communication or digital wireless broadcasting.

As used herein, "portable communication apparatus" refers to apparatuses users can carry to perform wireless communication with desired partners. Portable communication apparatuses include hand held phones (HHPs), CT-2 cellular phones, smart phones, digital phones, personal communication system (PCS) phones, PDAs, and laptop computers and may be classified into various types according to the appearance.

Portable communication apparatuses generally use a liquid crystal display (LCD) as the data output device and a keypad as the data input device, which is composed of an array of a number of keys.

Portable communication apparatuses have an antenna device positioned on their body to receive signals transmitted from partners. One of the outstanding issues regarding antenna devices is the tradeoff between the basic objective of increased antenna efficiency and the reduction of electromagnetic wave absorption, which has recently been problematic.

Conventional antenna devices used in portable terminals are classified as external antennas including whip antennas and helical antennas, which are positioned on the exterior of portable terminals, and internal antennas including inverted F-type antennas, flat-plate inverted F-type antennas, diversity antennas, and micro-strip antennas, which are positioned on the interior of portable terminals.

In addition, antenna devices for portable terminals are also classified as monopole-type antennas and flat plate-type antennas according to the method of exciting the radiated electromagnetic waves. The monopole-type antennas are generally external antennas, such as whip antennas and helical antennas. The flat plate-type antennas are generally those having flaky structure, such as inverted F-type antennas, flat-plate inverted F-type antennas, diversity antennas, and micro-strip antennas.

The construction of an internal antenna 3 will now be described with reference to FIGS. 1 to 4. A terminal 1 has EMI (electromagnetic interference) paint 5 applied to the inner surface of its case, which acts as a virtual ground to prevent electromagnetic waves from occurring inside the terminal. The terminal 1 includes a printed circuit board (PCB) 2 positioned therein and an internal planar antenna 3 positioned on the top end of the PCB 2 while being spaced at a predetermined height by an installation unit 4. The installation unit 4 secures a predetermined vertical gap between the PCB 2 and the antenna 3 for good transmission/reception of waves. Considering this, the PCB 2 and the antenna 3 are positioned with a predetermined separation during design.

The internal antenna 3 generally has a patch-type inverted-F shape. The ground size and the spacing (height) from the radiating body greatly affect the radiation characteristics. Experimental frequency tuning of the antenna shows that the antenna's size and the spacing from the ground are related to the operating frequency.

As shown in FIG. 3, variation in shape depending on the pattern of the EMI paint 5 just below the antenna may change the spatial separations and thus enable frequency tuning, in addition to tuning effects based on the size and height of the internal antenna 3.

As shown in FIG. 4, the terminal 1 has EMI paint 5 applied thereto, except for parts adjacent to the antenna, the EMI paint acting as a virtual ground to prevent EMI from occurring inside the case.

The internal antenna 3 is tuned to the operating frequency by varying the shape of the radiating body or using a device for the antenna. In the case of a patch antenna, which is fed by the amount of electric coupling, tuning is performed by adjusting the degree of insertion of the feeding line into the radiating body and the slope of the patch antenna relative to the ground surface.

However, conventional internal antennas have a problem in that, although they are tuned to resonate at a desired frequency by varying the size of the ground inside the PCB and the shape of the antenna's radiating body during frequency tuning, such tuning based on variation of length and shape has a limitation. This is because the size of the PCB, which is made of a composite resin material, is initially determined according to the specific application in most cases. When cutting or extending the antenna's radiating body, which is made of a metallic material, an additional process based on soldering is necessary. In addition, loss occurs to individual devices even when matching devices are used.

SUMMARY OF THE INVENTION

Accordingly, the present invention has been made to solve the above-mentioned problems occurring in the prior art, and an object of the present invention is to provide antenna tuning of a portable terminal capable of changing the application pattern of EMI paint, which is applied to the interior of the portable terminal, and varying the shape of the antenna's ground for easy tuning variation of the antenna's frequency.

In order to accomplish this object, there is provided a method for tuning the antenna of a portable terminal including the steps of applying EMI paint to the inner surface of a case of the terminal; positioning a PCB having a ground inside the terminal; positioning an internal antenna above the upper end of the PCB while being spaced at a predetermined height; applying EMI paint to the inner surface of the case in a predetermined pattern to provide a first region having a ground; and applying EMI paint while changing the application pattern to provide a second region extending from the first region and having a ground, the shape of which is varied to change the frequency tuning of the antenna.

BRIEF DESCRIPTION OF THE DRAWINGS

The above and other objects, features, and advantages of the present invention will be more apparent from the following detailed description taken in conjunction with the accompanying drawings, in which.

DETAILED DESCRIPTION OF THE PREFERRED EMBODIMENT

Hereinafter, preferred embodiments of the present invention will be described with reference to the accompanying drawings. In the following description of the present invention, a detailed description of known functions and configurations incorporated herein is omitted to avoid making the subject matter of the present invention unclear.

Figure 5:
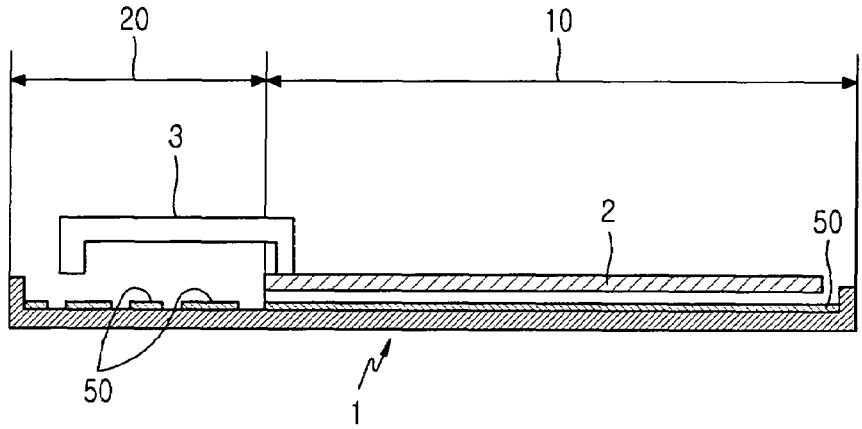
FIG. 5 is a lateral sectional view showing antenna tuning of a portable terminal using EMI paint according to an embodiment of the present invention.
Figure 6:
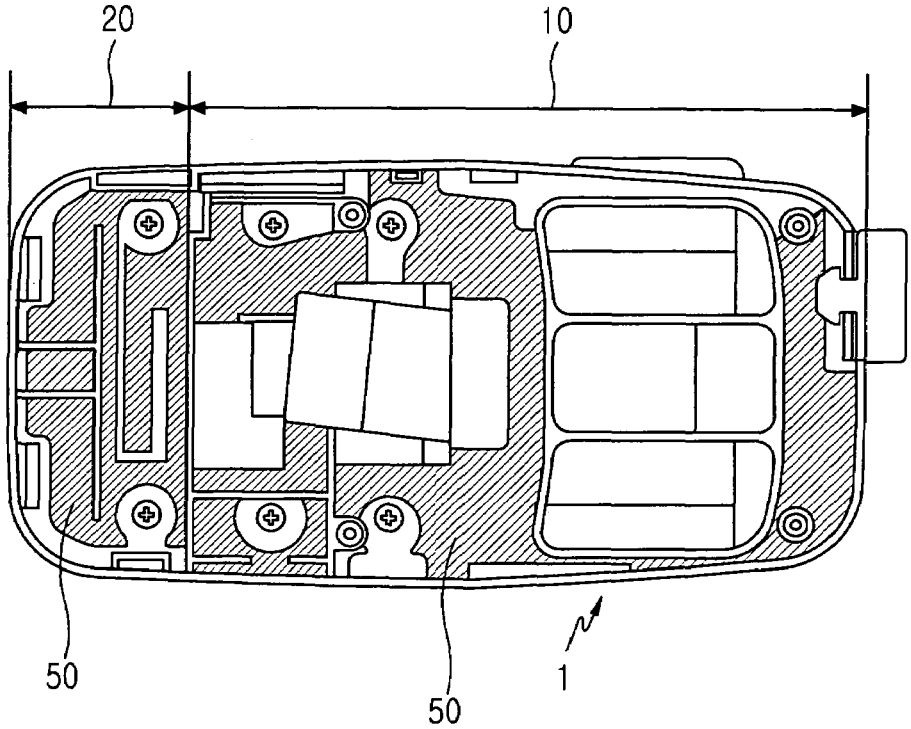
FIG. 6 is a front view showing a pattern of EMI paint used in antenna tuning of a portable terminal using EMI paint according to an embodiment of the present invention.

According to antenna tuning of a portable terminal using EMI paint 50 as shown in FIGS. 5 and 6, the inner surface of a case of the terminal 1 is divided into first and second regions 10 and 20. The first region 10 has EMI paint 50 applied thereto in a predetermined pattern and is positioned on the inner surface of the case of the terminal 1 to provide a ground (not shown). The second region 20 has EMI paint 50 applied thereto while varying the application pattern and provides a ground (not shown). The second region 20 extends from the first region 10 to vary the tuning of the resonance frequency by changing the shape of the ground.

As shown in FIG. 5, a PCB 2 is positioned on the top surface of the first region 10 and has a ground inside the terminal 1.

An internal antenna 3 is positioned on the top surface of the second region 20 while corresponding to the ground of the second region 20. The internal antenna 3 is positioned on an end of the PCB 2, as well as on the outer periphery thereof.

The operation of antenna tuning of a portable terminal using EMI paint according to a preferred embodiment of the present invention, constructed as above, will now be described in more detail with reference to FIGS. 5 to 8.

As shown in FIGS. 5 and 6, the interior of a case of a portable terminal 1 is divided into first and second regions 10 and 20. EMI paint 50 is applied to the first region 10 in a predetermined pattern.

The first region 10 is provided with a ground (not shown). A PCB 2 for the terminal 1 is positioned on the top surface of the first region 10. EMI paint 50 is applied to the second region 20 while varying the pattern. The second region 20 is provided with a ground. An internal antenna 3 is positioned on the top surface of the second region 20.

The pattern of EMI paint 50 of the second region 20 provided inside the case of the terminal 1 is varied and the shape of the ground provided together with application of EMI paint 50 is changed for easy variation of the frequency tuning of the antenna 3.

Such variation of the ground's shape by simply changing the pattern of EMI paint 50 during tuning of the antenna 3 is a major improvement over the conventional method of cutting and extending the radiating body or matching device of the antenna 3, during tuning of the antenna 3, in a separate soldering process.

Variation in shape of the ground on the lower end of the internal antenna 3 affects the electrical length of the antenna 3. This is used for resonance frequency tuning of the antenna 3.

Figure 7:
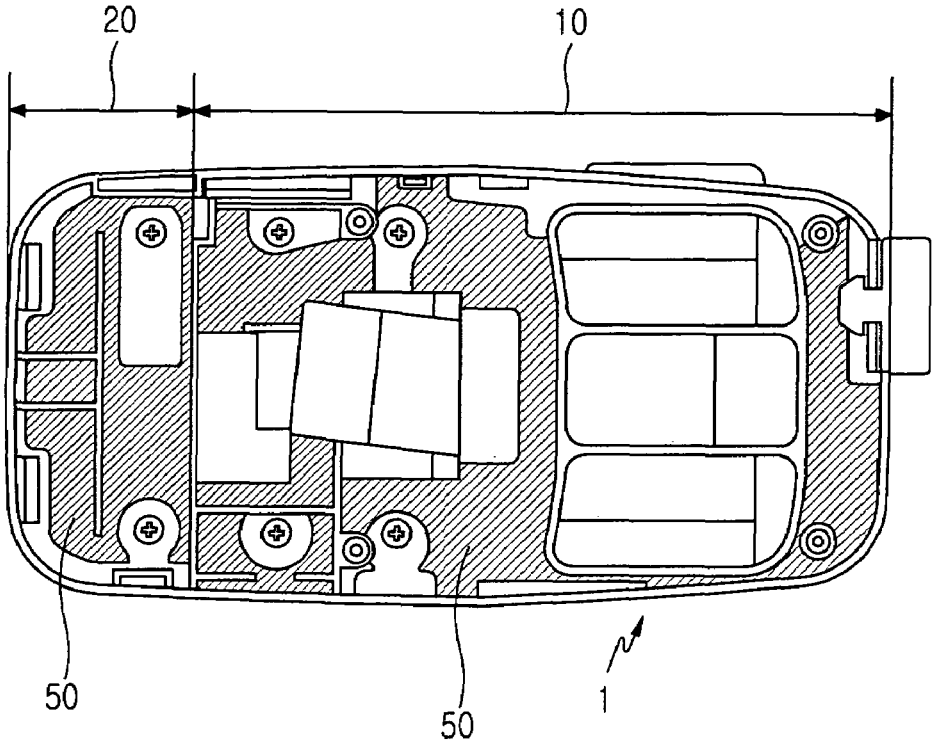
FIG. 7 is a front view showing an alternative pattern of EMI paint used in antenna tuning of a portable terminal using EMI paint according to an embodiment of the present invention.

FIG. 7 shows a pattern of EMI paint inside a portable terminal used to vary the shape of the ground of the antenna according to another embodiment of the present invention. As shown, the user can change the pattern of EMI paint 50 to vary the resonance frequency of the antenna.

Figure 1:
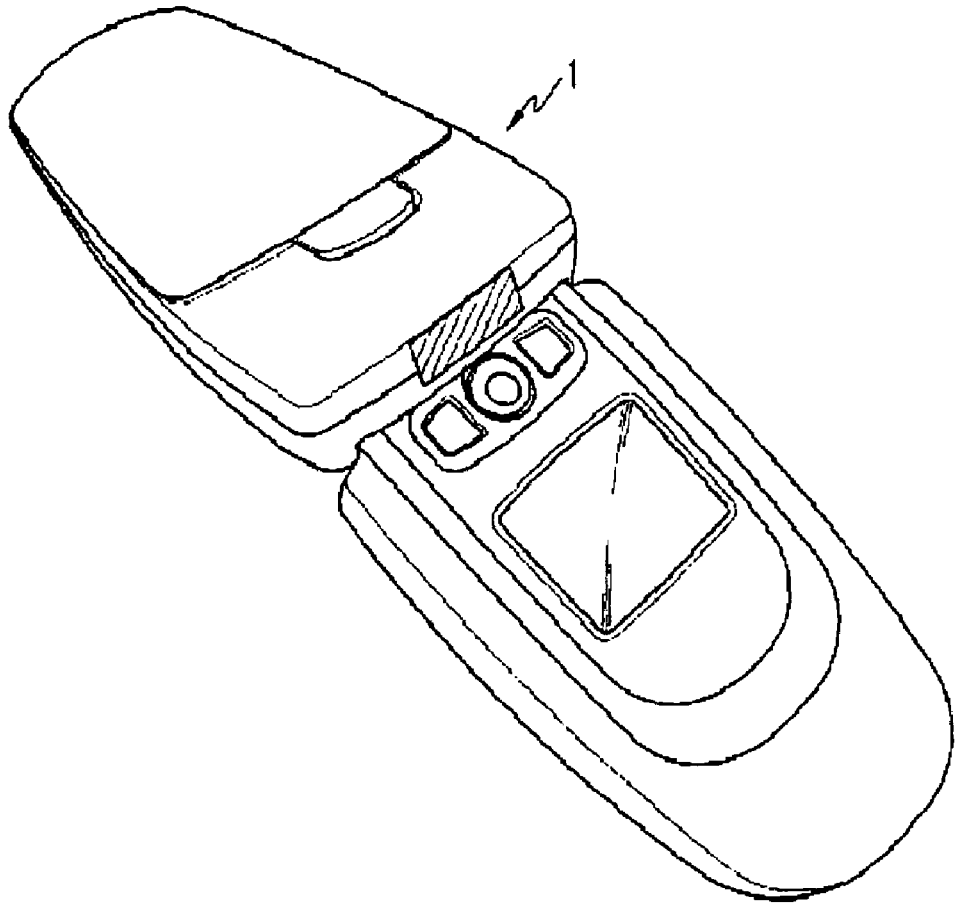
FIG.1 (PRIOR ART)
FIG. 1 is a perspective view showing a folder-type terminal having a conventional internal antenna.
Figure 2:
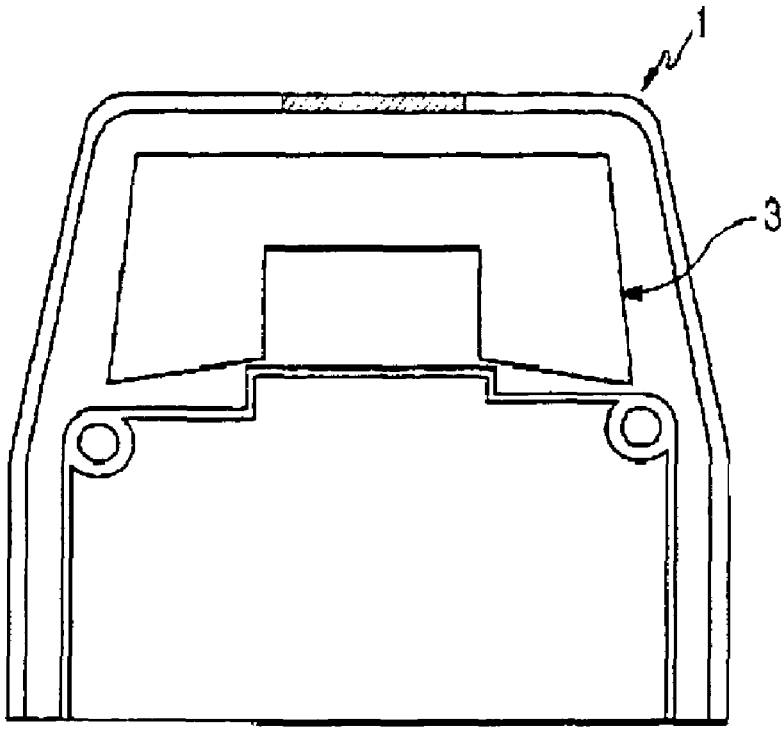
FIG.2 (PRIOR ART)
FIG. 2 is a top view showing the interior of the terminal shown in FIG. 1.
Figure 3:
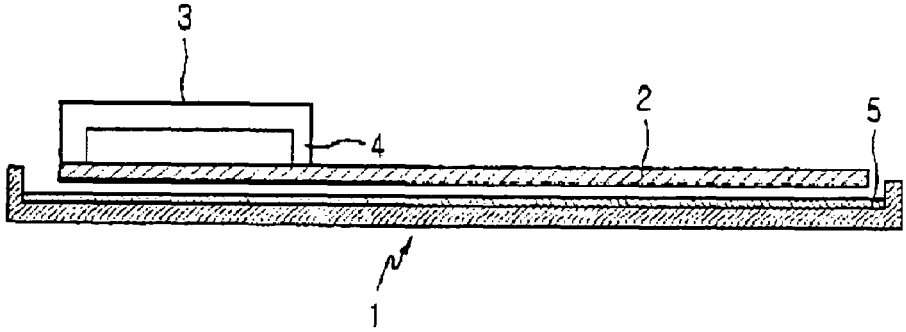
FIG.3 (PRIOR ART)
FIG. 3 is a lateral sectional view showing the application pattern of EMI paint inside a conventional portable terminal.
Figure 4:
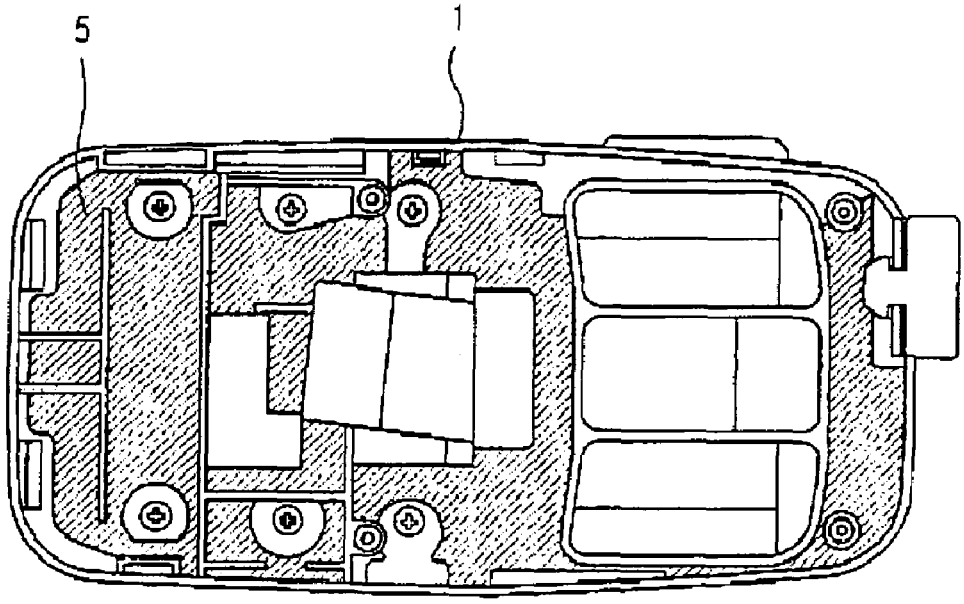
FIG.4 (PRIOR ART)
FIG. 4 is a front view showing the application pattern of EMI paint on the inner surface of a conventional portable terminal.
Figure 8:
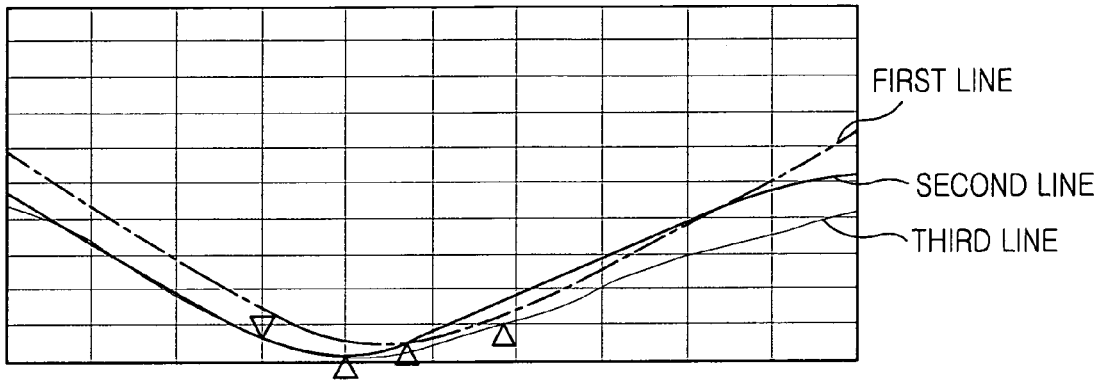
FIG. 8 is a graph showing the change of VSWR according to variation of shape in antenna tuning of a portable terminal using EMI paint according to an embodiment of the present invention.

FIG. 8 is a graph showing the frequency characteristics and the change of VSWR (voltage standing wave ratio) of the antenna. In the graph, the first line corresponds to a case wherein conventional EMI paint 5 is applied as shown in FIG. 4; the second line corresponds to a case wherein the pattern of EMI paint 50 is changed to vary the ground's shape, as shown in FIG. 6, and shift to a lower frequency has occurred; and the third line corresponds to a case wherein EMI paint 50 is applied to the interior of the portable terminal in a different pattern to vary the shape of the antenna's ground, as shown in FIG. 7.

In the case of an internal antenna 3, the ground may be incorporated into the antenna 3 together with the radiating body in a broader sense. When the ground is positioned on the PCB 2, there is some trouble in varying the shape. However, the pattern of EMI paint 50 can be changed to vary the shape of the ground for easy variation of the antenna's tuning.

In summary, a pattern change of EMI paint on the lower end of the antenna additionally provides a suitable means of tuning, when it is impossible to vary the size of a ground which has a fixed size or the electrical length of the radiating body.

While the invention has been shown and described with reference to certain preferred embodiments thereof, it will be understood by those skilled in the art that various changes in form and details may be made therein without departing from the spirit and scope of the invention as defined by the appended claims. For example, the present invention is applicable to all kinds of portable terminals.

What is claimed is:

1. A method for tuning an antenna of a portable terminal comprising the steps of:

applying electromagnetic interference (EMI) paint to an inner surface of a case of the terminal;

positioning a printed circuit board (PCB) provided inside the terminal;

positioning an internal antenna above an upper end of the PCB while being spaced at a predetermined height;

applying EMI paint to the inner surface of the case to provide a first region having a ground; and changing an application pattern of EMI paint to provide a second region extending from the first region, to create a varied shape of the second region to change a frequency tuning of the antenna.

2. The method as claimed in claim 1, wherein the PCB is positioned on a top surface of the first region.

3. The method as claimed in claim 1, wherein the internal antenna is positioned on a top surface of the second region.

4. The method as claimed in claim 1, wherein the internal antenna is positioned on an end of the PCB, as well as on an outer periphery thereof.

5. A method for tuning an antenna of a portable terminal comprising the steps of:

applying electromagnetic interference (EMI) paint to an inner surface of a case of the terminal;

positioning a printed circuit board (PCB) provided inside the terminal;

positioning an internal antenna above an upper end of the PCB while being spaced at a predetermined height;

applying additional EMI paint to the inner surface of the case, while changing an application pattern, to provide at least one region; and varying the shape of the application pattern, as the application of the additional EMI paint changes, to vary the tuning of frequency.

* * * * *